US008994630B2

(12) United States Patent
Pak et al.

(10) Patent No.: US 8,994,630 B2
(45) Date of Patent: Mar. 31, 2015

(54) DISPLAY, APPARATUS AND METHOD FOR DRIVING DISPLAY

(75) Inventors: Sang-Jin Pak, Yongin-si (KR); Joo-Hyung Lee, Seoul (KR); Ho-Suk Maeng, Seoul (KR); Young-Ok Cha, Gwangmyeong-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 1474 days.

(21) Appl. No.: 12/337,333

(22) Filed: Dec. 17, 2008

(65) Prior Publication Data

US 2010/0149200 A1 Jun. 17, 2010

(51) Int. Cl.
*G09G 3/36* (2006.01)
*G09G 5/393* (2006.01)

(52) U.S. Cl.
CPC ..... *G09G 5/393* (2013.01); *G09G 3/3648* (2013.01); *G09G 2320/0252* (2013.01); *G09G 2320/0271* (2013.01); *G09G 2320/0276* (2013.01); *G09G 2320/103* (2013.01)
USPC ..... 345/89; 345/690

(58) Field of Classification Search
CPC ..... G09G 3/2033; G09G 2300/0809; G09G 3/2014; G09G 3/2037; G09G 3/3648; G09G 3/2025; G09G 3/2029; G09G 2300/0823; G09G 2320/0247; G09G 3/204; G09G 2300/0814; G09G 2320/0633; G09G 3/2022; G09G 3/2011; G09G 3/3688; G09G 2310/027; G09G 3/3611
USPC ..... 345/87–100, 204, 208–214, 545–547, 345/690
See application file for complete search history.

(56) References Cited

U.S. PATENT DOCUMENTS

| | | | | |
|---|---|---|---|---|
| 7,742,030 | B2 * | 6/2010 | Tsai et al. | 345/94 |
| 7,937,114 | B2 * | 5/2011 | Yamagishi | 455/566 |
| 2003/0151599 | A1 * | 8/2003 | Bone | 345/204 |
| 2006/0022922 | A1 * | 2/2006 | Jinda et al. | 345/87 |
| 2007/0146272 | A1 * | 6/2007 | Yoon et al. | 345/89 |
| 2007/0299900 | A1 * | 12/2007 | Chiang | 708/628 |
| 2010/0020110 | A1 * | 1/2010 | Yamato | 345/690 |
| 2012/0162293 | A1 * | 6/2012 | Hudson et al. | 345/691 |

FOREIGN PATENT DOCUMENTS

| | | |
|---|---|---|
| JP | 2008-070561 | 3/2008 |
| KR | 10-2005-0050123 | 5/2005 |
| KR | 10-2006-0049880 | 5/2006 |
| KR | 10-2006-0083072 | 7/2006 |

* cited by examiner

*Primary Examiner* — Kevin M Nguyen
*Assistant Examiner* — Mansour M Said
(74) *Attorney, Agent, or Firm* — F. Chau & Associates, LLC

(57) ABSTRACT

An apparatus for driving a display panel includes a first memory which stores a frame image data, a second memory which stores overshooting information. The apparatus receives an image signal from an external system via a CPU interface process. The second memory stores a difference data between the frame image data and an overshooting data. The overshoot is then calculated from the difference data and the frame image data. The apparatus also includes a two-line memory which stores an image signal of an n-th frame in a line unit and an image signal of an n−1-th frame in another line. The two-line memory compares the consecutive two frame data, so that the apparatus extracts overshooting information from a look up table.

18 Claims, 5 Drawing Sheets

FIG. 3

| | BIT | 256 | 128 | 64 | 32 | 16 | 8 | 4 | 2 |
|---|---|---|---|---|---|---|---|---|---|
| INPUT DATA | 8 | | | | | | | | |
| STORED DATA | 4 | | | | | 0 | 0 | 0 | 0 |

FIG. 4

| mDCC LUT | | PREVIOUS DATA | | | | | | | | |
|---|---|---|---|---|---|---|---|---|---|---|
| | | 0 | 32 | 65 | 97 | 130 | 162 | 194 | 227 | 255 |
| CURRENT DATA (8bit) | 0 | 0 | 0 | 0 | 0 | 0 | 0 | 0 | 0 | 0 |
| | 32 | 97 | 0 | 0 | 0 | 0 | 0 | 0 | 0 | 0 |
| | 65 | 128 | 36 | 0 | 0 | 0 | 0 | 0 | 0 | 0 |
| | 97 | 125 | 53 | 20 | 0 | 0 | 0 | 0 | 0 | 0 |
| | 130 | 109 | 53 | 40 | 20 | 0 | 0 | 0 | 0 | 0 |
| | 162 | 81 | 40 | 36 | 20 | 12 | 0 | 0 | 0 | 0 |
| | 194 | 57 | 36 | 28 | 24 | 16 | 12 | 0 | 0 | 0 |
| | 227 | 24 | 20 | 16 | 16 | 12 | 12 | 8 | 0 | 0 |
| | 255 | 0 | 0 | 0 | 0 | 0 | 0 | 0 | 0 | 0 |

D(fn) : DATA FOR CURRENT FRAME
D(fn-1) : DATA FOR PREVIOUS FRAME
D'(fn) : OVER-DRIVING DATA FOR CURRENT FRAME
ΔO(fn) : D'(fn)-D(fn)
LUT : LOOK UP TABLE
FFB : FULL FRAME BUFFER
HFB : HAF FRAME BUFFER

DISPLAY, APPARATUS AND METHOD FOR DRIVING DISPLAY

BACKGROUND OF THE INVENTION

1. Field of the Invention

The present disclosure is directed to a display and an apparatus for driving the display. More particularly, the present disclosure is directed to a display and an apparatus and a method for driving the display having a central processing unit (CPU) interface mode or other interface modes.

2. Description of the Related Art

Compact liquid crystal display (LCD) apparatuses have become widely used in various fields, so that various conditions and functions of the LCD apparatuses have also become necessary. For example, a compact LCD apparatus, such as a digital camera, a digital multimedia broadcasting (DMB) device, etc., requires high display resolution and high display quality.

However, since the compact LCD apparatus is primarily manufactured to display still images, the response speed of liquid crystals is slow and the response speed of a gray scale is much slower. An overdriving technology is applied to improve the response speed through the entire gray scale range to easily display the video image. In the overdriving technology, the present inputted frame image signal is compensated so that the response time of the liquid crystal (LC) molecules become faster. For example, an image signal of an (n−1)-th frame is compared with an image signal of an n-th frame next to the (n−1)-th frame, to output a compensated image signal of the n-th frame. The current compact LCD apparatus stores the image signal in a frame memory of the LCD apparatus via a central processing unit (CPU) interface process. This process is synchronized to an external clock signal of the LCD apparatus. The image signal is outputted and provided to the LCD by a control signal which is synchronized to the internal clock signal of the LCD apparatus.

Thus, the image signal is not transmitted from the external system to the display panel in real time, so that the image signal received from the external system is not synchronized with the image signal applied to the display panel. This is the reason why the CPU interface mode needs a frame memory. The frame memory is an apparatus storing the image signal. Some other interface modes like RGB interface mode need neither to store the image signal nor a frame memory to store the image signal.

SUMMARY OF THE INVENTION

An embodiment of the present invention provides an apparatus for driving a display panel enhancing display quality of a moving image in a central processing unit (CPU) interface mode.

Another embodiment of the present invention provides an apparatus for driving a liquid crystal display including a first buffer storing image data of current frame, a second buffer storing a value of difference between the current image data and a current overshooting data, and an arithmetic unit calculating the current overshooting data from the stored data in the first and the second buffer, wherein the second buffer size is between about 30% and about 70% of the first buffer size.

Another embodiment of the present invention provides an apparatus for driving a liquid crystal display including a first buffer storing image data of current frame, a second buffer storing a value of difference between the current image data and a current overshooting data, an arithmetic unit calculating the current overshooting data from the stored data in the first and the second buffer, and a comparing buffer that compares image data of two consecutive frames of the liquid crystal display.

Another embodiment of the present invention provides an apparatus for driving a liquid crystal display including a first buffer storing image data of a current frame, a second buffer storing a value equal to the difference between the current image data and a current overshooting data, an arithmetic unit calculating the current overshooting data from the stored data in the first and the second buffer, and a look up table that has overshooting image data information of the latter frame by comparing two consecutive frame image data, wherein the look up table stores full gray overshooting data or the difference between the overshooting data and the original image data.

Another embodiment of the present invention provides an exemplary method for driving a display including a storing step of original image data in a first buffer, a storing step of difference data between the original image data and an overshooting image data in a second buffer, and a calculating step of the overshooting image data with the original image data and the difference data between the original image data.

Another embodiment of the present invention provides an exemplary method for driving a display including a storing step of original image data in a first buffer, a storing step of difference data between the original image data and an overshooting image data in a second buffer, an extracting step of the difference between the original image data and the overshooting data, and an extracting step of the overshooting data from a look up table.

Another embodiment of the present invention provides an exemplary method for driving a display including a storing step of original image data in a first buffer, a storing step of difference value between the original image data and an overshooting image data in a second buffer, and a comparing step of the image data of two consecutive frames.

Another exemplary embodiment of the present invention provides a display including a first buffer storing image data of a current frame, a second buffer storing a value of difference between the current image data and a current overshooting data, and an arithmetic unit calculating the current overshooting data from the stored data in the first and the second buffer, wherein the second buffer size is between about 30% and 70% of the first buffer size.

Another exemplary embodiment of the present invention provides a display including a first buffer storing image data of a current frame, a second buffer storing a value of difference between the current image data and a current overshooting data, and an arithmetic unit calculating the current overshooting data from the stored data in the first and the second buffer, and a comparing buffer that compares image data of two consecutive frames.

According to an embodiment of the present invention, a compact display apparatus using a CPU interface process provides a compensated image signal of the n-th frame.

BRIEF DESCRIPTION OF THE DRAWINGS

The above and other features of the present invention will become more apparent by describing in detail example embodiments thereof with reference to the accompanying drawings.

FIG. 3 is an example of data processing that reduces eight bit data to four bit data.

FIG. 4 is a table which shows a result of data processing in accordance with an embodiment of the present invention.

DESCRIPTION OF EXEMPLARY EMBODIMENTS

Embodiments of the invention are described more fully hereinafter with reference to the accompanying drawings, in which exemplary embodiments of the invention are shown. This invention may, however, be embodied in many different forms and should not be construed as limited to the embodiments set forth herein. It will be understood that when an element or layer is referred to as being "on," "connected to" or "coupled to" another element or layer, it can be directly on, connected or coupled to the other element or layer or intervening elements or layers may be present. Like numbers refer to like elements throughout.

Hereinafter, exemplary embodiments of the present invention will be explained in detail with reference to the accompanying drawings.

Figure 1:
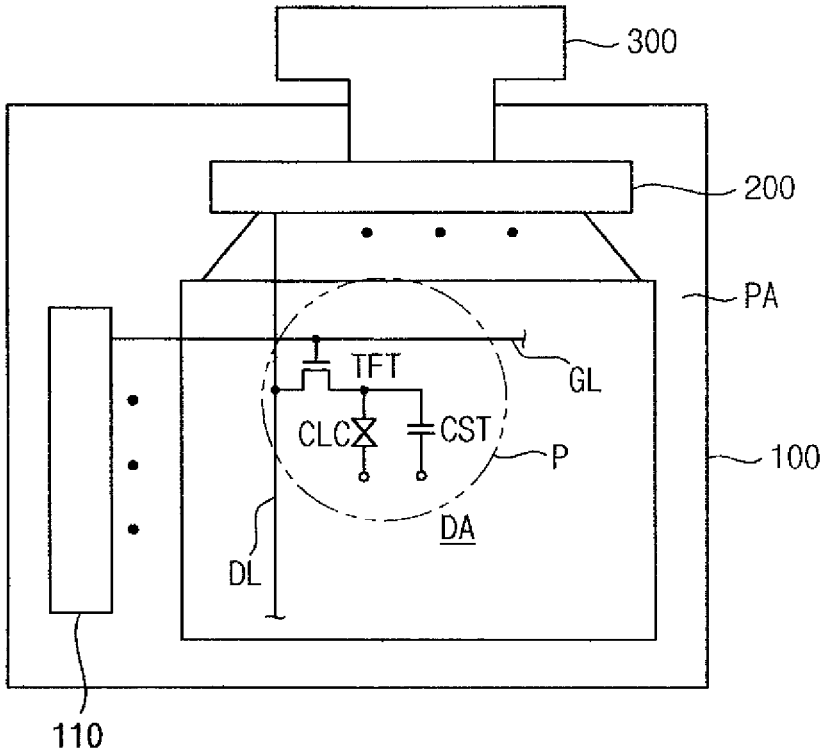
FIG. 1 is a plan view illustrating a display apparatus according to an example embodiment of the present invention.

FIG. 1 is a plan view illustrating a display apparatus according to an example embodiment of the present invention.

Referring to FIG. 1, the display apparatus includes a display panel 100, an apparatus 200 for driving a display panel and a flexible printed circuit board (FPC) 300.

The FPC electrically connects an external system (not shown) with the apparatus 200. The external system is connected to the apparatus 200 via a central processing unit (CPU) interface process to transmit an image signal and a control signal.

The display panel 100 includes a display area DA having a plurality of pixel portions and a peripheral area PA enclosing the display area DA. Each of the pixel portions P includes a switching element TFT electrically connected to a gate line GL and a source line DL, a liquid crystal capacitor CLC electrically connected to the switching element TFT, and a storage capacitor CST electrically connected to the liquid crystal capacitor CLC.

The apparatus 200 and a gate driving part 110 are disposed in the peripheral area PA. The apparatus 200 is mounted on the peripheral area PA corresponding to an end portion of the source line DL. The apparatus 200 may be a chip. The apparatus 200 may be embedded on the glass through a photolithography process. The gate driving part 110 may be embedded through a photolithography process in the peripheral area PA corresponding to an end portion of the gate line GL, or be mounted on the peripheral area PA with an integrated circuit (IC) chip.

The apparatus 200 generates a compensated image signal of an n-th frame by comparing an image signal of the n-th frame transmitted via the CPU interface process and a stored image signal of an (n−1)-th frame, and outputs the compensated image signal of the n-th frame to the source line. The number n is a natural number.

The gate driving part 110 outputs a gate signal to each of the gate lines, based on a gate control signal provided from the apparatus 200.

Figure 2:
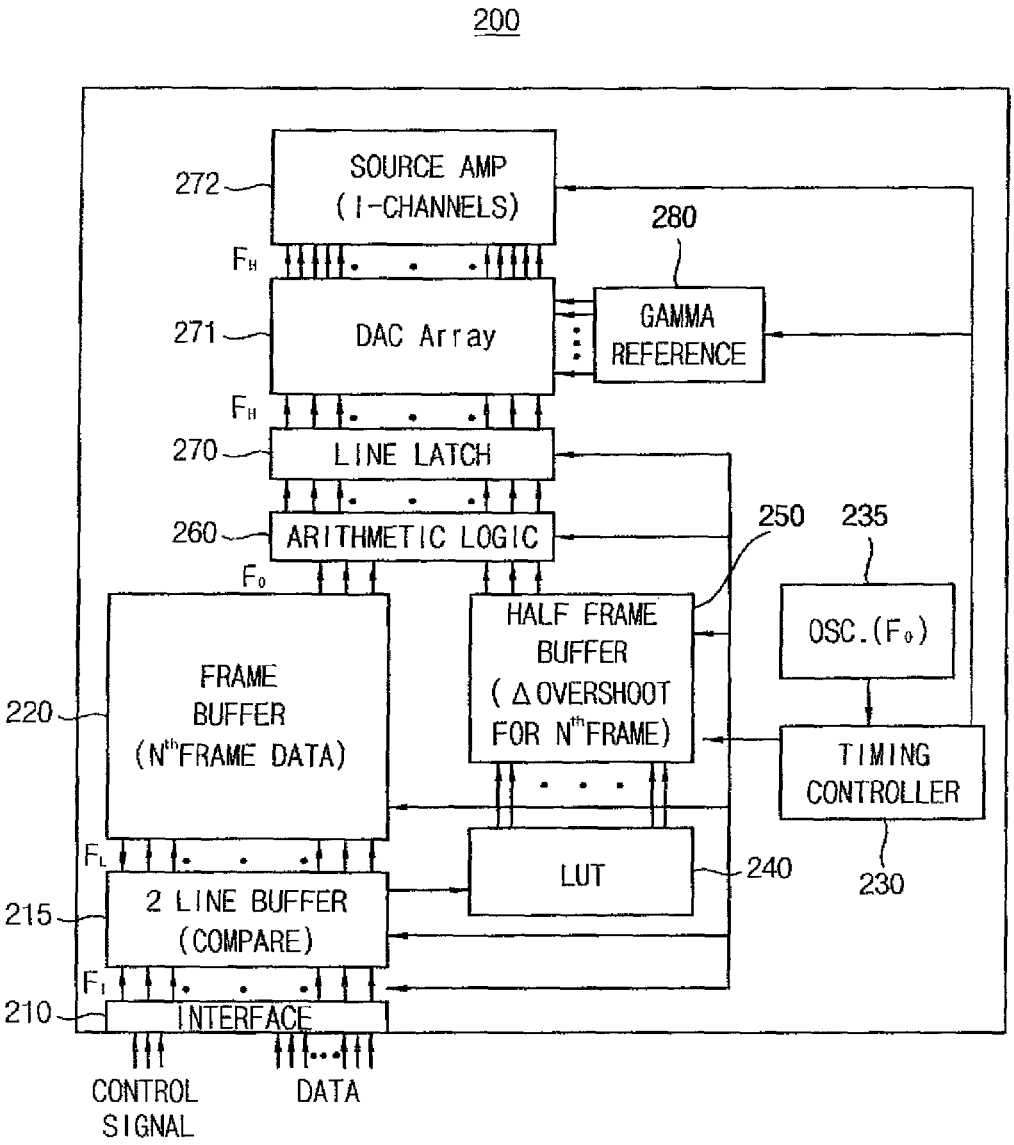
FIG. 2 is a block diagram illustrating an apparatus for driving a display panel according to an example embodiment of the display apparatus in FIG. 1.

FIG. 2 is a block diagram illustrating an apparatus 200 for driving a display panel according to an example embodiment of the present invention.

Referring to FIGS. 1 and 2, the apparatus 200 according to the present example embodiment includes an interface block 210, a two-line-buffer 215, a frame buffer 220, a timing control part 230, a clock generating part 235, a look up table (LUT) 240, a half frame buffer 250, an arithmetic logic 260, a line latch 270, a digital to analog converter (DAC) 271, a source amplifier 272, and a gamma reference 280.

The apparatus 200 may be called a source drive integrated circuit (IC). The source drive IC 200 may further include a gate signal control block. The source drive IC 200 may not include a block that is shown in FIG. 2, for example, the clock generating part 235, the timing controller 235, the gamma reference 280 etc. If these are not included in the source IC 200, these may be located on the display panel 100 or in the external system (not shown).

There is an LCD driving method that is called dynamic capacitance compensation (DCC). DCC is applied to a moving picture to get fast response time of the moving picture of an LCD. Pixel voltages of the DCC driving are higher or lower than voltages of static images to compensate for the dynamic capacitance of pixels of an LCD. To compensate for the dynamic capacitance of the pixels, precise compensation of gray levels should be adopted. If the fully compensated gray level number is 256, 8 bits of memory per pixel is required to store the gray level data. If a display needs more memory, it costs more. There will be an optimum balance between the cost and the display quality according to the application of the displays. One exemplary embodiment of the present invention is a method to reduce the memory used in a DCC application. One example of reducing the memory is shown in FIG. 3. Storing a 256 gray level data signal needs 8 bits memory. If the 4 most significant bits (MSB) are stored and the 4 least significant bits (LSB) are discarded, the compensated data is not that precise. Even though the compensated data is coarse, the image is usually better than the uncompensated data. This example shows saving memory from 8 bits to 4 bits with a coarse compensation.

Figure 5:
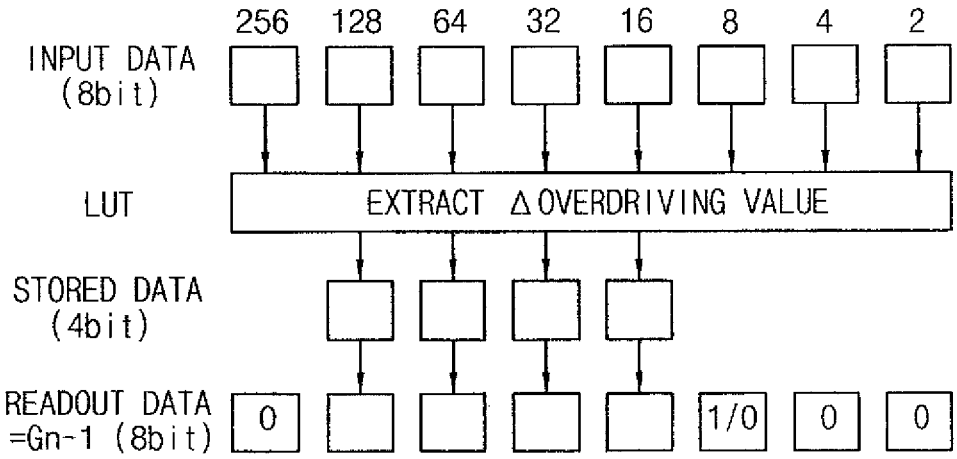
FIG. 5 is an example of data processing that reduces eight bit data to four bit data.

FIG. 3 shows a case that the compensated stored data is full gray data. Another exemplary embodiment of the present invention is storing the difference between compensated gray data and the present image gray data. FIG. 4 shows the differences. Because the overshooting data is more significant than the undershooting data, FIG. 4 shows only the overshooting data. In this case the difference is less than or equal to 128. This means 7 bits can express all of the gray differences of a 256 gray level image system. If the four least significant bits are dropped, then 3 bits of memory can store the same amount of information that 4 bits of memory can store in FIG. 3. In other words, 4 bits of memory of this embodiment can store more information than the 4 bits of memory of prior art. More information permits more precise and better image quality. This scheme is shown in FIG. 5. FIG. 5 also shows the LSB 3 digits can be set to the middle value of the gray, which is able to produce better images. Regarding the binary digit system, 100 will be the middle value between 000 and 111.

Some of the values in FIG. 4 may be larger than 128 for some devices. The larger values may be substituted by 128 because the number of the larger value will be a small portion of the whole value.

Hereinafter the signal flow will be explained with reference to the FIG. 2.

The interface block 210 receives a control signal and data signal from the external system (not shown) and transmits the data signal to the two-line-buffer 215. The two line buffer 215 receives one line current data signal from the interface block 210 and one line data signal of the former frame from the frame buffer 220. The data signals of each correspond with each other which means corresponding data are applied in the same pixel order.

The two-line-buffer 215 compares each of the corresponding data so that an appropriate value in the LUT 240 can be stored to the corresponding place of the half frame memory 250. The half frame memory 250 stores overshooting information of the corresponding pixel. The LUT 240 has all the overshooting information. FIG. 4 may be one example of the overshooting information. Another example of the overshooting information may be a full gray level from a 1 gray level to a 256 gray level. FIG. 4 needs less memory than the latter. After the signal data in the frame buffer is extracted to the two-line-buffer, the current data signals are stored to the corresponding place in the frame buffer 220. In this procedure, all the former frame data in the frame buffer are replaced by the current frame data.

Heretofore the storing procedure to the frame buffer 220 and the half frame buffer 250 is explained. Hereinafter a reading out procedure from the frame buffer 220 and the half frame buffer 250 and writing the image data to the LC capacitance CLC will be explained.

The arithmetic logic 260 reads the data stored in the frame buffer 220 and the data stored in the half frame buffer 250 and matches corresponding data to extract appropriate data that is to be sent to digital to analog converter (DAC) array 271. The line latch 270 keeps the extracted data and sends a bunch of data at a time. The bunch of data may be for example the same number of data to one horizontal line of the display, a half of one horizontal line of the display, the same number of data to one vertical line of the display, or any other type of data. The DAC array 271 converts the gray data to the voltages which is applied to the pixel electrode of the display. The DAC array 271 extracts the voltages from the gamma reference block 280. The source amplifier 272 stabilizes the voltages so that reliable voltages can reach each pixel electrode. Although FIG. 2 shows an example that the latch 270 is placed between the arithmetic logic 260 and the DAC array 271, the line latch 270 may be placed between the DAC array 271 and the source amplifier 272.

The clock generator (oscillator) 235 generates a clock signal. The timing controller 230 receives the clock signal from the clock generator 235 and generates control signals which transfers to the interface block 210, the 2 line buffer 215, the frame buffer 220, the half frame buffer 250, and some other units as shown in the FIG. 2. The two line buffer 215 may be substituted by another size buffer.

Figure 6:
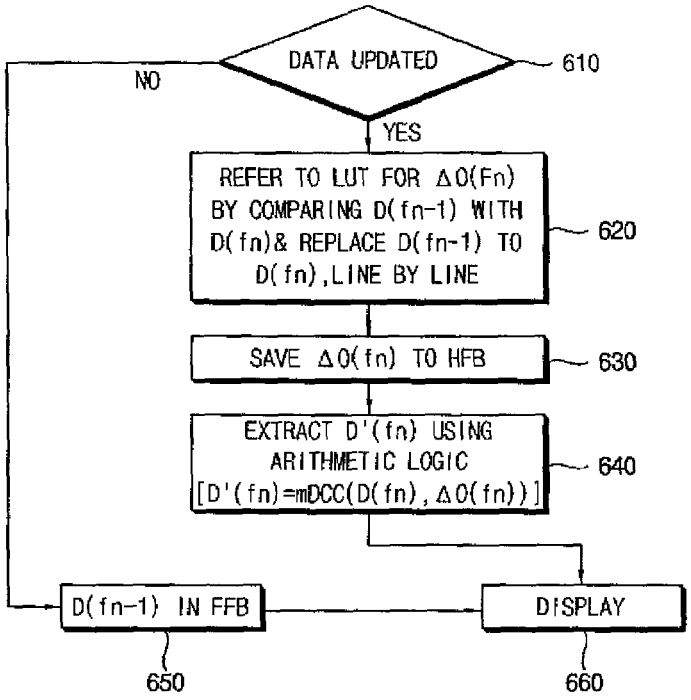
FIG. 6 is a flow chart showing data processing in accordance with an example embodiment of the present invention.

FIG. 6 shows an operation sequence of one exemplary embodiment. If the image data of the current frame is not updated (step 610), the n−1-th frame (fn−1) data in full frame buffer (FFB) is displayed (step 650) on the display (step 660). If the image data of the current frame is updated (step 610), overshoot data of the n-th frame ΔO(fn) is extracted from the LUT by comparing the data of n−1-th frame and the data of n-th frame (step 620). The n−1-th frame data D(fn−1) in the FFB is replaced by the n-th frame data D(fn) line by line (step 620). ΔO(fn) is saved in the half frame buffer (HFB) (step 630). The arithmetic logic 260 extracts n-th frame compensated data D'(fn) from the data stored in the FFB and the data stored in the HFB (step 640). The compensated data D'(fn) will be displayed on the display (step 660).

Having described example embodiments of the present invention and their features, it is noted that various changes, substitutions and alterations can be made herein without departing from the spirit and scope of the invention as defined by appended claims.

What is claimed is:

1. An apparatus for driving a liquid crystal display, the apparatus comprising:

a first buffer storing image data of a current frame;

a look up table that has overshooting data when the image data of the current frame is greater than image data of a consecutive preceding frame and that has no overshooting data when the image data of the current frame is less than image data of the consecutive preceding frame;

a second buffer storing data representing a difference between the image data of the current frame and a current overshooting data; and an arithmetic unit calculating the current overshooting data from data in the first and the second buffer, wherein the current overshooting data is for only a portion of bits of the image data of the current frame and wherein three least significant bits of the image data are set to a middle value of a gray scale.

2. The apparatus of claim 1, wherein the second buffer is smaller in memory size than the first buffer.

3. The apparatus of claim 2, wherein the second buffer size is between about 30% and 70% of the first buffer size.

4. The apparatus of claim 1, further comprising: a comparing buffer that compares image data of consecutive frames.

5. The apparatus of claim 4, wherein the comparing buffer is a two-line-buffer that substantially stores image data of two horizontal display lines of liquid crystal display.

6. The apparatus of claim 1, wherein the look up table stores full gray overshooting data or the difference between in the overshooting data and the original image data.

7. A method for driving a display, the method comprising:

storing original image data in a first buffer;

storing data representing a difference between the original image data and an only overshooting image data in a second buffer, setting three least significant bits of the original image data to a middle value of a gray scale, and extracting overshooting data for only a portion of hits of the original image data.

8. The method of claim 7, further comprising: calculating the overshooting image data with the data stored in the first and the second buffer.

9. The method of claim 7, further comprising: extracting the difference data between the original image data and overshooting image data.

10. The method of claim 9, further comprising: extracting the overshooting image data from a look up table.

11. The method of claim 7, further comprising:

comparing the image data of two consecutive frame, wherein if the two consecutive frame data is same, the latter image data is applied to the display and if the two consecutive frame data is different, the latter image data is stored in the first buffer.

12. A display comprising:

a first buffer storing image data of a current frame;

a look up table that has overshooting data when the image data of the current frame is greater than image data of a consecutive preceding frame and that has no overshooting data when the image data of the current frame is less than image data of the consecutive preceding frame;

a second buffer storing data representing a difference between image data of the current frame and a current overshooting data; and an arithmetic unit calculating the current overshooting data from data in the first and the second buffer, wherein the current overshooting data is for only a portion of bits of the image data of the current frame and wherein three least significant bits of the image data are set to a middle value of a gray scale.

13. The display of claim 12, wherein the second buffer is small in memory size than the first buffer.

14. The display of claim 13, wherein the second buffer size is between about 30% and 70% of the first buffer size.

15. The display of claim 12, further comprising: a comparing buffer that compares image data of two consecutive frames.

16. The display of claim 15, wherein the comparing buffer is a two-line-buffer that substantially stores image data of two horizontal display lines of the liquid crystal display.

17. The display of claim 12, wherein the look up table stores full gray overshooting data.

18. The display of claim 12, wherein the data transferring interface is a central processing unit interface.

* * * * *